United States Patent [19]

Livingston et al.

[11] Patent Number: 4,509,543

[45] Date of Patent: Apr. 9, 1985

[54] INDUSTRIAL DISHWASHER MONITOR/CONTROLLER WITH SPEECH CAPABILITY

[75] Inventors: James W. Livingston; James G. Schontzler, both of Santa Cruz, Calif.

[73] Assignee: Beta Technology, Inc., Santa Cruz, Calif.

[21] Appl. No.: 531,753

[22] Filed: Sep. 12, 1983

[51] Int. Cl.[3] ..... B08B 7/04

[52] U.S. Cl. ..... 134/57 D; 134/18; 134/113; 364/513.5

[58] Field of Search ..... 134/18, 25.2, 57 D, 134/113; 364/400, 146, 185, 513.5

[56] References Cited

U.S. PATENT DOCUMENTS

| | | | |
|---|---|---|---|
| 2,859,760 | 11/1958 | Borell | 134/57 D X |
| 3,896,827 | 7/1975 | Robinson | 134/18 X |
| 4,142,539 | 3/1979 | Shih et al. | 134/113 |
| 4,195,500 | 4/1980 | Tobita et al. | 134/113 X |
| 4,245,309 | 1/1981 | Kiefer | 134/57 D X |
| 4,272,649 | 6/1981 | Pfeiffer | 364/513.5 |
| 4,375,329 | 3/1983 | Park | 364/513.5 X |
| 4,387,269 | 6/1983 | Hashimoto et al. | 364/513.5 |

OTHER PUBLICATIONS

LeBoss, *Electronics,* "Speech I/O is Making itself Heard", May 22, 1980, p. 95.

*Primary Examiner*—Marc L. Caroff

*Attorney, Agent, or Firm*—Flehr, Hohbach, Test, Albritton & Herbert

[57] ABSTRACT

A dishwasher monitor/controller for monitoring the operation of a dishwasher and providing human-intelligible speech messages upon the detection of predefined fault conditions. The operation of the dishwasher is periodically monitored using temperature measurements, water conductivity measurements, detection of the absence of drying agent, and timers to measure how long various physical conditions continue between periodic maintenance procedures. The dishwasher faults detected include directly tested faults and indirectly (elapsed-time dependent) tested faults. The direct tests for faults are for low rinse water temperature, low wash water temperature, and absence of drying agent. The indirect tests are for dirty wash water, absence of detergent, and the need to inspect the interior of the washer for dirt and calcium carbonate scale build-up. Furthermore, there is provided a switch activated facility for orally explaining, step-by-step, how to properly start-up the dishwasher and how to shut it down.

3 Claims, 2 Drawing Figures

DISHWASHER SYSTEM

DISHWASHER SYSTEM

INDUSTRIAL DISHWASHER MONITOR/CONTROLLER WITH SPEECH CAPABILITY

Figure 1:
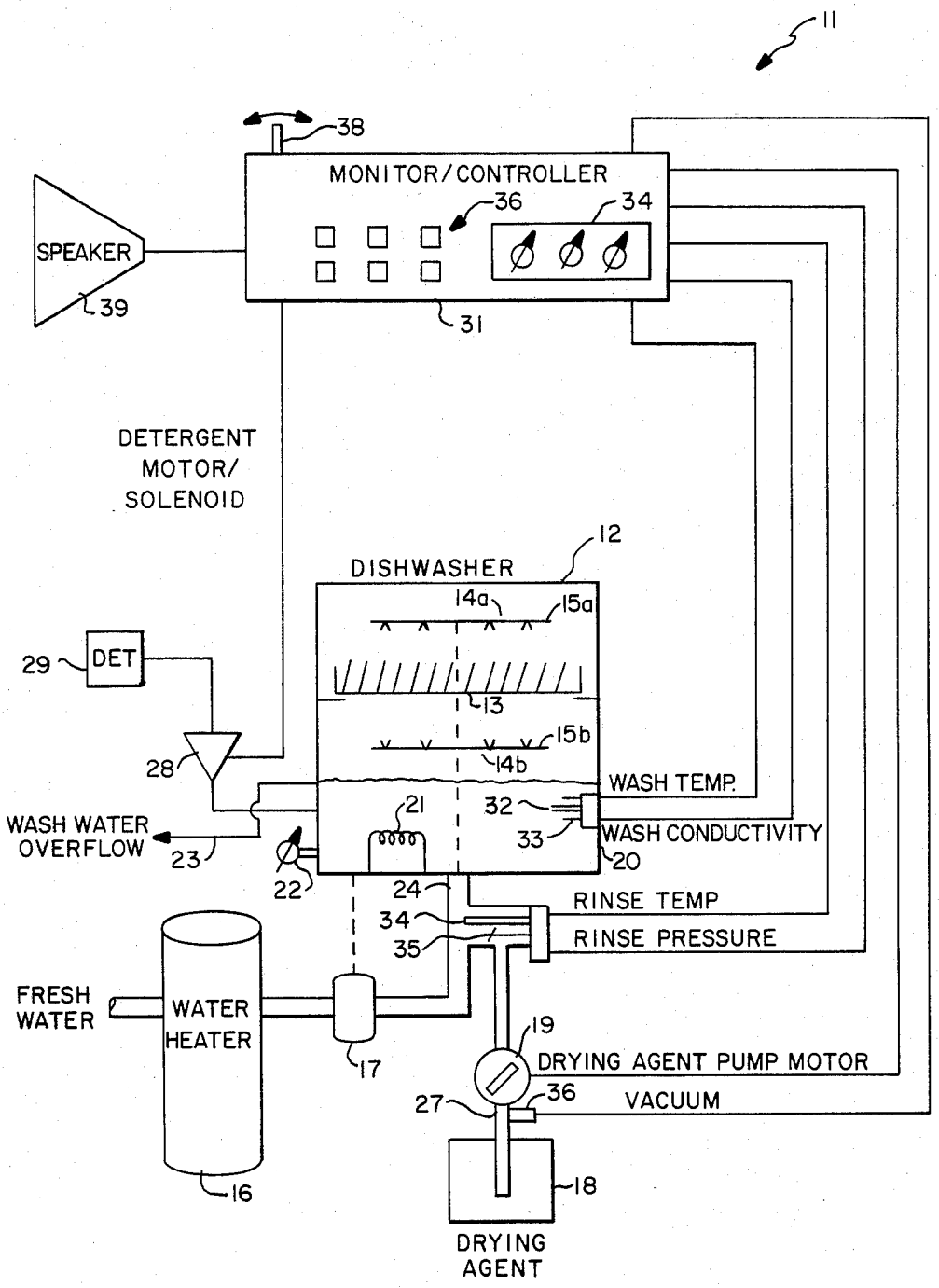

This invention relates generally to dishwashing machines and more particularly to a monitor/control apparatus and method for use in conjunction with an industrial dishwasher and its detergent and drying agent pumping apparatus.

Industrial dishwashers are used in hotels, restaurants and other institutional settings. They are typically operated by low-paid, unmotivated personnel, many of whom have subnormal intelligence. While the operation of these machines is not complicated, several problems occur on a regular basis, all of which affect the cleanness of the dishes being washed by the dishwashing machine. Briefly, these problems, which are discussed in greater detail below, are: running out of detergent, running out of drying agent, failure to drain and replace wash water after it becomes too dirty, failure to periodically inspect the washer arms and filters for accumulated refuse, failure to turn on water heater for heating water used to wash the dishes, and failure to turn on water heater for heating rinse water.

Prior art monitor and control apparatus for industrial dishwashers have had the capability of monitoring wash and rinse water temperature, for monitoring the amount of detergent added and for detecting the absence of detergent and drying agent. For each error condition there is usually a corresponding light on a panel and possibly a corresponding beep or tone from a small noise generator. These prior art machines, however, have not had the ability to determine when the wash water should be changed or when the machines should be inspected for scale formation buildup. Furthermore, the warning lights and beeps are sometimes considered confusing by the person running the dishwasher, who may not bother to look closely at the panel to determine which warning light is on, and are also easily ignored.

Another problem with prior art machines relates to the training of new personnel to operate the machine. There is often a high turnover rate among the people employed as dishwashers. Also, written instructions for operating the machine, especially for turning the machine on and for turning it off, are read mostly by managers. Dishwasher operators are usually instructed on these procedures orally a couple of times and then are expected to remember what to do. If the operator forgets what to do or the order of the steps to be followed, the dishwasher may not operate properly and the dishes in the dishwasher will not be sanitized.

It is a primary object of this invention to provide an improved monitor and control apparatus for use in conjunction with industrial washing machines which is capable of giving the operator of the machine oral messages when any one of several operating problems is detected.

It is another object of this invention to provide an apparatus which can give the operator of an industrial washing machine oral step-by-step instructions on how to start-up a dishwashing machine and on how to shut it down.

In a preferred embodiment the monitoring apparatus has a microcomputer controller which periodically monitors several operation conditions. The operation conditions monitored are the temperature of the water entering the washing machine, the temperature of the water in the wash tank, the conductivity/resitivity of the water in the wash tank, the speed of the motor which adds drying agent to the dishwashing machine, whether the washer is off or on, the presence of drying agent in the drying agent feed line, the pressure on the rinse water line, the time elapsed since the last time the wash tank water was purged, and the time elapsed since the last time the machine's sprayers and interior walls were inspected.

In the preferred embodiment six tests are performed. When one of the tested conditions is improper, one or more phrases of speech are transmitted to the operator warning of the problem and specifying the correct remedial action. Three of the tests are direct measurements of physical conditions while three are indirect in that they draw inferences from the amount of elapsed time between defined events. The three direct tests are as follows. The temperature of the wash and rinse water are monitored directly by the use of thermostats and compared with minimum acceptable values for each. When a fault is detected the operator is asked to turn on the proper water heater. The absence of drying agent is detected by use of a vacuum switch in the dispenser tube for drying agent.

The three indirect tests are as follows. First, the amount of time the rinse water pump is on is accumulated. If the rinse water is not drained within a predetermined amount of rinse-water-flow-time a message is generated telling the operator to drain the dirty rinse water and replace it with new water. If the operator drains the water before the predetermined time period elapses, the timer is reset and the message is not generated.

Second, the rinse time is accumulated in a second timer to indicate when the operator should inspect the machine's sprayer arms, filters and interior walls for dirt and scale build-up. Calcium carbonate scale formation can destroy sprayer arms and interior walls if not periodically removed. After a predetermined amount of rinse-water-flow-time has elapsed a flag is set. The flag causes a message to be transmitted the next time the rinse water is drained requesting the operator to perform the required inspection. After the message is transmitted the timer is restarted.

These two timers make use of an indirect measurement, rinse-water-pump-time, corresponding to how much the machine has been used. They help insure that periodic maintenance procedures necessary for producing sanitized dishes and maintaining the integrity of the dishwasher are followed.

The third indirect test is for the absence of detergent. The proper amount of detergent is added to the wash water by monitoring the conductivity or resistivity of the wash water as the detergent is added to it and stopping the motor when a predetermined conductivity/-resistivity is reached. The absence of detergent is detected by the failure to reach the proper conductivity/-resistivity after a predetermined amount of time.

The invention and objects and features thereof will be more readily apparent from the following detailed description and appended claims when taken in conjunction with the drawing, in which FIG. 1 depicts a dishwasher machine and the monitoring and control equipment attached thereto.

Figure 2:
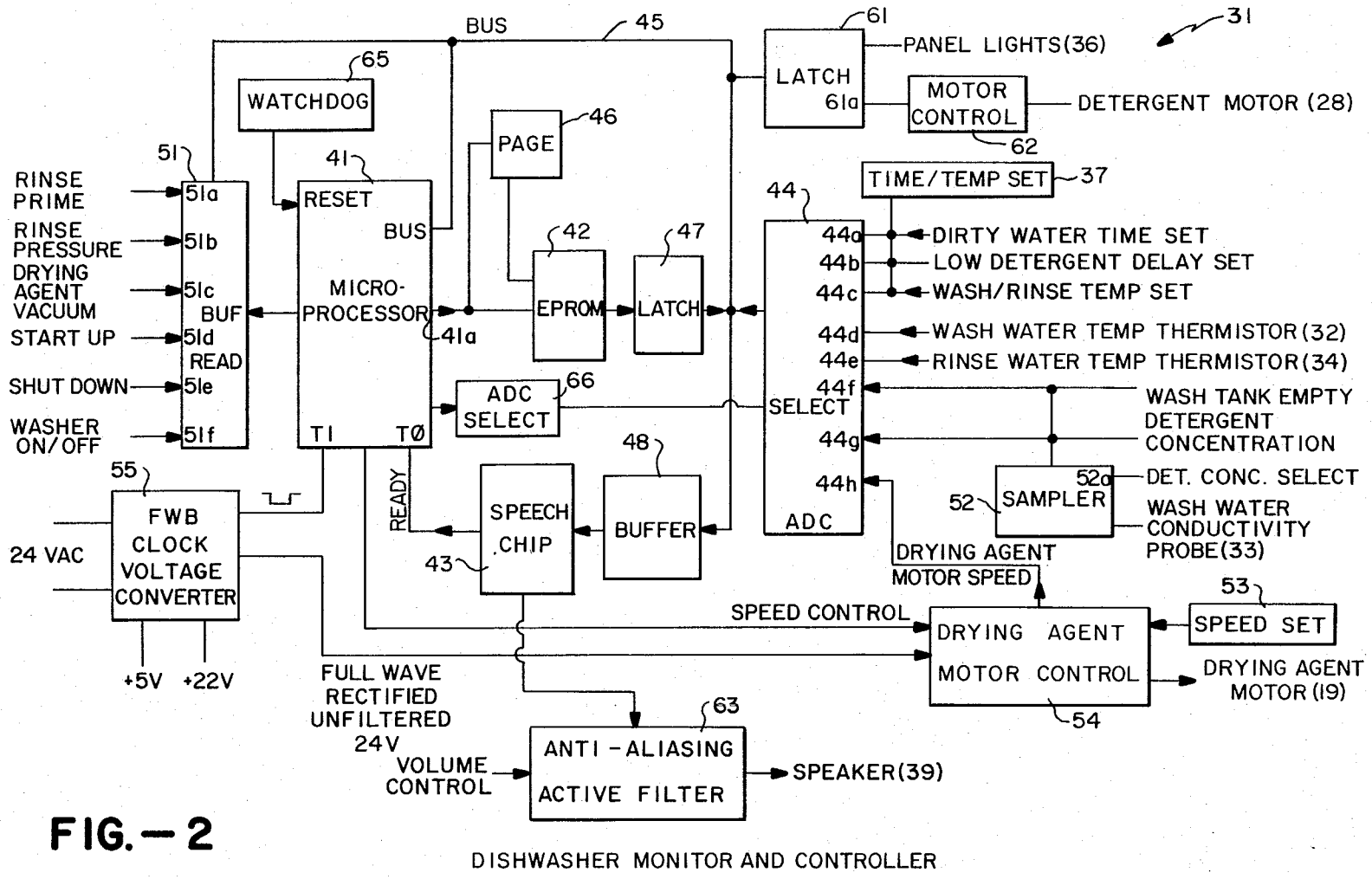

FIG. 2 depicts a block diagram of the monitor and control apparatus of the present invention.

Referring to FIG. 1 there is shown a block diagram of a dishwasher system 11 in accordance with the present invention. The dishwasher 12 can be any one of several commercially sold industrial dishwashers. Therefore, the dishwasher 12 can be either of the batch type or the conveyorized type. In either type of dishwasher 12 the dishes are first subjected to a flow of wash water for a period typically ranging between forty-five seconds and one minute thirty seconds and are then subjected to rinse water for a period typically ranging between ten seconds and thirty seconds. In a batch type of dishwasher 12 one or more trays 13 of dishes are placed inside dishwasher 12 and then subjected to a wash cycle and then a rinse cycle and are then removed before the next set of dish trays 13 is washed. In a conveyorized dishwasher 12 trays of dishes travel on a conveyor through two sections: a wash section and then a rinse section. The monitor and controller system 31 described below is designed for use with either type of system, and distinctions between these two types of dishwashers 12 is generally not relevant herein.

The water used in the wash cycle is generally recycled water held in a water tank 20 below the trays of dishes 13. Thus the dishes being cleaned are initially sprayed, using sprayer arms 14*a* and 14*b* above and below the dishes, with water from the water tank 20 that has been used before. The wash water contains a predetermined amount of detergent for sanitizing the dishes. The water used to rinse the dishes is clean, hot water sprayed on the dishes using sprayer arms 15*a* and 15*b* which are concentrically mounted with the sprayer arms for wash water 14*a* and 14*b*. The wash water sprayer arms 14*a* and 14*b* and the rinse water sprayer arms 15*a* and 15*b* have completely distinct plumbing (not shown in FIG. 1). The rinse water is clean fresh water which is preheated using a water heater 16. When it is time to rinse the dishes a solenoid 17 is activated by the dishwasher 12 thereby allowing water to flow into the rinse sprayer arms 15*a* and 15*b*. As the rinse water flows into the dishwasher 12 a drying agent is drawn from a container 18 by means of a motor or pump 19 and is added to the flow of rinse water in rinse water line 24. The drying agent, as its name indicates, facilitates the drying of the dishes after they are removed from the dishwasher 12 and helps prevent spotting.

The water tank 20 below the dish trays 13 typically holds approximately fifteen gallons of water per tray of dishes processed by the dishwasher. As water is added to the tank 20 during the rinse cycle the tank 20 overflows into overflow line 23. The wash water tank 20 also contains an immersible heater 21 for heating the wash water when the dishwasher 12 is first started up and also for maintaining the wash water at a temperature sufficient to sanitize dishes. The dishwasher 12 typically has a temperature control 22 for setting the temperature of the water in wash tank 20.

The monitor and controller apparatus 31 of the present invention is connected to the dishwasher 12 as follows. First, it is connected to thermistor 32 in the wash tank 20 for determining the temperature of the wash water. It is also connected to two probes 33 in the wash tank 20 which are a predetermined distance from one another and which are used to determine the resistivity or conductivity of the wash water. This resistivity or conductivity measurement can be used to determine the amount of detergent in the water and also to determine if the wash tank 20 is empty or full. Next, the monitor 31 is connected to a thermistor 34 in the rinse water line 24 to determine the rinse water temperature. Also the monitor is connected to a pressure switch 35 which detects increases in pressure in the rinse water line 23. The monitor 31 is connected to the drying agent pump or motor 19 both for the purpose of detecting the speed of the motor 19 and also for controlling that speed. The monitor 31 is connected to a vacuum switch 36 connected to the drying agent feed line 27 for detecting the absence of drying agent in container 18. Similarly, the monitor 31 is connected to the motor or solenoid 28 which controls the addition of detergent to the wash water in tank 20 from detergent dispenser 29. The motor or solenoid 28 is a pump if the detergent is a fluid and is a solenoid with a mixing mechanism if the detergent is a dry chemical.

The monitor and controller 31 has a set of lights 36, each corresponding to different potential problems and the proper operation of the dishwasher 12. A series of dials 37 are used to select several parameter values described below for controlling the operation of the monitor controller 31. The two-position center-position-off switch 38 is used by the operator of the dishwasher 12 for obtaining instructions on how to start-up the dishwasher 12 and how to shut it off. Finally, a speaker 39 transmits messages to the operator of the dishwasher 12 when any one of a set of predefined faults or error conditions is detected by the monitor/controller 31.

Referring to FIG. 2 there is shown a block diagram of the dishwasher monitor/controller 31. The major components of the monitor/controller 31 are a microprocessor 41, which is an 8039 made by Intel in the preferred embodiment; an 8k×8 EPROM (electrically programmable read only memory) which is a 2764 made by Texas Instruments in the preferred embodiment; a speech chip 43, which is a 5220 made by Texas Instruments in the preferred embodiment; and an analogue to digital converter (ADC) 44. The microprocessor 41 is connected to most of the elements of the monitor/controller 31 by a bus 45, which is eight bits wide.

EPROM 42 contains both the computer programs used by the microprocessor 41 and also encoded speech data for use by the speech chip 43. In the preferred embodiment 2k bytes of the 8k EPROM are reserved for firmware and the other 6k of the EPROM 42 are reserved for speech data. Since an 8k EPROM requires thirteen address lines and the address port 41*a* of the microprocessor 41 has only eight lines, a paging circuit 46 is used for generating the high order address bits for the EPROM 42. Data from the EPROM 42 is transmitted to a synchronized latch 47 which puts the data on the bus 45. When the data from the EPROM 42 is speech data it is transmitted by buffer 48 to the speech chip 43. Control lines not shown in FIG. 2 enable and disable the transmission of data by buffer 48 to the speech chip 43. Except for when speech data is being transmitted to the speech chip 43, all data on the bus 45 is transmitted to and read by the microprocessor 41.

Input signals from the dishwasher 12 and its associated monitoring equipment fall into basically two categories: on/off signals and qualitative signals. The on/off signals are buffered by buffer 51 which then transmits them onto the bus 45. These signals are: drying agent prime 51*a* (prime drying agent pump 19), rinse pressure 51*b*, drying agent vacuum 51*c*, start-up 51*d*, shutdown 51*e*, and washer on/off 51*f*.

The qualitative input signals are first processed by an analogue to digital converter (ADC) 44 before being transmitted to the bus 45. Three of these input signals 44*a*–44*c* are parameter values selected by the installer of the monitor/controller 31. The dirty water time set 44*a* is the maximum amount of rinse water flow time (which is equivalent to drying agent pump motor 19 operation time) before the water in the wash tank 20 is purged and replaced. The low detergent delay set 44*b* is the amount of time it should take the pump to add the proper amount of detergent to the wash water. The wash/rinse temperature set signal 44*c* is really two signals. The wash temperature set is the minimum acceptable temperature for the wash tank 20 water. The rinse temperature set is the minimum acceptable temperature for the rinse water. The wash water temperature set value can range, in the preferred embodiment, from 110° F. to 160° F. and is typically set at 140° F. The rinse water temperature set value can range from 130° F. to 180° F. and is typically set at around 165° F.

The other qualitative input signals reflect the conditions in the dishwasher 12 and the speed of the drying agent pump motor 19. Analogue input 44*d* is connected to the wash water temperature thermistor 32 which generates a voltage value corresponding to the temperature of the wash water in the wash tank 20. Analogue input 44*e* is connected to the rinse water temperature thermistor 34. Analogue inputs 44*f* and 44*g* are derived from measurements of the conductivity of the water in the wash tank 20. A sampler circuit 52 creates pulses which are capacitively coupled to the wash water conductivity probes 33. The resulting voltage across the conductivity probes 33 is proportional to the resistivity of the water in the wash tank 20. The resistivity of the wash water is tested in two different resistivity ranges by the sample circuit 52. The first range of resistivity values is the range normally associated with different levels of detergent in the water. A second range of higher resistivity values is used to distinguish between clean wash water from an empty wash tank 20. Input signal 44*h* is proportional to the speed of the drying agent pump motor 19. If the speed of the motor 19 is greater than the value determined by speed set circuit 53 the input signal 44*h* is in one range; if it is close to or equal to the predetermined speed it is in a second range, and if it falls below the predetermined speed the signal 44*h* is in a third range. Drying agent motor control 54 uses a standard post and pedestal technique for controlling the speed of the drying agent pump motor 19. When rinse prime signal 51*a* is "on" the monitor/controller 31 activates the drying agent pump motor 19 until the signal 51*a* goes "off". This fills the drying agent feed tube 27, as required for proper operation.

The qualitative input signals 44*a*–44*h* are serially read by the microprocessor 41 during each cycle period, using ADC select circuit 66 to serially select each of the eight input lines to the ADC 44.

Two other input signals to the microprocessor 41 are TØ, indicating the speech chip 43 is ready for more speech data, and T1, a 120 hertz clock signal generated by voltage converter circuit 55. The voltage converter circuit 55 converts a twenty-four volt a.c. input into five volts d.c., twenty-two volts d.c., and a twenty-four volt (full wave rectified but unfiltered) internal power supplies. The 120 hz clock signal T1 controls the cycle period of the microprocessor 41. Thus, the cycle period of the microprocessor 41 is approximately 8.33 milliseconds.

The output signals generated by the monitor/controller 31 are as follows. Panel lights 36, each corresponding to a distinct operating condition or fault, are set up by latch 61, which is connected to the bus 45. An on/off signal for the detergent motor 28 is also output by latch 61. Motor control 62 translates the on/off signal 61*a* from the latch 61 into a voltage level (typically twenty-four volts) suitable for use by the detergent motor 28. The output signal for the drying agent pump motor 19 is a speed control signal used by the drying agent motor control 54 to control pump motor 19.

The main other outputs from the monitor/controller 31 are speech phrases generated by the speech chip 43. The microprocessor 41 sends speech data to the speech chip 43 only when an error condition is detected or when the operator activates the start-up/shut-down switch 38. The output from the speech chip 43 is filtered and amplified by an amplifier and anti-aliasing active filter 63 before being transmitted to a speaker 39.

Finally, a "watchdog" circuit 65 resets the microprocessor if no activity on the ADC select circuit 66 is detected for a predetermined amount of time (approximately one cycle period, 8.33 milliseconds).

The dishwasher monitor/controller 31 operates as follows. During normal operation the main task of the monitor/controller 31 is to monitor the various input signals and to control the two motors 19 and 28 for drying agent and detergent. The drying agent pump motor 19 is activated whenever clean rinse water is flowing into the dishwasher 12. The flow of rinse water is detected by a pressure switch 35 connected to the rinse water feed line 24. The relatively high pressure on the rinse water feed line 24 when the solenoid 17 is open, compared to when it is closed and the rinse water is not flowing, is used by the pressure switch 35 to provide a rinse on/off signal 51*b* for use by the microprocessor 41. The speed of the drying agent pump motor 19 is selected by adjustment of speed set 53 which is basically a pot resistor that controls the gain of an op-amp. The drying agent motor control 54 works by transmitting only that fraction of the full wave rectified (but unfiltered) twenty-four volt supply waveform necessary to produce the selected motor speed.

The detergent motor control 62 is an on/off device without speed control. As detergent is added to the wash water the resistivity of the water drops. When it reaches a certain value close to the selected target value the motor control 62 is turned alternately on for three seconds and off for three seconds until the selected target resistivity is reached.

The operation of each test performed by the monitor/controller 31 is as follows. First, consider the three direct tests for wash water temperature, rinse water temperature, and for the presence of drying agent. As described above, the eight inputs 44*a*–44*h* to the ADC 44 are individually selected for reading by the microprocessor 41 by use of ADC select circuit 66. Also, the wash and rinse water set values are selected by using pot-type dials in time/temperature set circuit 37. These temperature set values are periodically read in through ADC 44 input 44*c* for comparison with the measured temperatures. The two signals are read through a single ADC input 44*c* by using the simple expedient of having two controllable switches for alternately connecting one pot-resistor and then the other to the ADC input 44*c*.

The wash tank 20 water temperature is read in periodically, through ADC input 44*d*, but is tested only when the wash tank 20 is full. The test for wash tank 20 empty/full is as follows. A series of pulses are transmitted by sampler circuit 52 to the conductivity probes 33 in the wash tank 20. The resulting voltage on the probes 33 is proportional to the resistivity of the water or air between the probes 33. If there is air between the probes 33 a very high resistivity will be measured and monitor/controller 31 will conclude that the wash tank 20 is empty. One result of finding the wash tank 20 to be empty is that the temperature of the wash tank 20 is not checked. When the wash tank 20 is not empty (and the washer on/off signal 51*f* is "on") the measured temperature is compared with wash water temperature set value (signal 44*c*). If the wash water temperature is below the selected minimum value for the wash water an internal flag is set which is used to generate a corresponding warning light and speech message. The generation of speech messages is described later.

The rinse water temperature is measured and compared against its selected set value whenever the dishwasher 12 is on (signal 51*f*). If the measured temperature falls below the selected minimum value, a corresponding warning light 36 is turned on and a speech message is generated.

The presence of drying agent is detected by use of a vacuum switch 36 on the drying agent feed line 27. A yes/no signal is sent by the vacuum switch 36 periodically whenever the dishwasher is turned on. The relative "vacuum" in the drying agent feed line 27 is caused by the gravitational pressure on the liquid in feed line 27 which is vertically displaced over the drying agent container 18 and under the drying agent pump 19 (which in the preferred embodiment must be at least twenty-four inches higher up than the container 18 to ensure proper operation of the vacuum switch 36). When the drying agent feed line 27 is not quite empty, but only has a small amount of drying agent (e.g., 12 inches of feed tube 27 volume) therein, the vacuum switch 36 will detect the "absence" of drying agent, thereby providing warning of the need to add more drying agent slightly before the supply is actually exhausted.

The three "indirect" tests involve the use of time measurement. Time measurement is accomplished simply by counting cycle periods, of which there are 120 per second. Since there are several time dependent functions, a separate "timer" (i.e., actually a separate memory location and accumulated time update routine) is used to keep track of each elapsed-time value. Also, since the microprocessor 31 uses only eight-bit words and the relevant elapsed time values range from a fraction of a second to as long as 100 minutes, some of the timers are more complex than others.

The first indirect test is for the presence of detergent in the detergent container 29. Whenever the dishwasher is on (i.e., washer on/off signal 51*f* is "on") and the wash tank 20 is not empty (see discussion above), the concentration of detergent in the wash tank 20 is measured by measuring the resistivity of the wash water. If the resistivity is higher than the value selected by the installer (sampler circuit 52 input 52*a*)—which corresponds to a selected concentration of detergent in the wash tank 20—the microprocessor 41 turns on the detergent motor/solenoid 28 to add detergent to the wash tank 20.

The test for the presence/absence of detergent is basically that if the proper resistivity is not achieved within a specific time period, the monitor/controller 31 concludes that the operator needs to replace the detergent container 29 or add detergent to it. A more detailed description is as follows.

The installer of the monitor/controller 31 adjusts the pot-dial in time/temperature set circuit 37 corresponding to input signal 44*a*, selecting a value corresponding to the time it normally takes to add the proper amount of detergent to a new tank 20 of wash water. Since the time it takes to reach the target detergent concentration may vary somewhat, and also because it is desirable to avoid giving false alarms, the time value selected by the installer will generally exceed the standard detergent feed time by fifty percent or so.

Another aspect of adding detergent to the wash tank 20 is the problem of overshoot. This problem derives from the natural but variable delay between the time the detergent is added to the wash water to the time it is dissolved and evenly distributed. Overshoot occurs when more than the optimal amount of detergent is added because detergent is added before the amount of detergent can be reliably tested. The apparatus of the present invention solves this problem by adding detergent to the wash water intermittently after the resistivity of the water falls below a level which is close to the target level (e.g., corresponding to 80% of the target detergent concentration). Thus, the detergent monitor/solenoid 28 is alternately turned on for three seconds and off for three seconds until either the target resistivity is achieved or the time delay period elapses, indicating that the detergent supply has run out. Also, by shutting off the detergent motor/solenoid 28 after twice the selected time delay period elapses the monitor/controller 31 avoids loss of the full detergent supply in the event the conductivity probe 33 malfunctions.

The second indirect test is to ensure that the wash tank 20 is purged sufficiently often to prevent the wash water from becoming so dirty that the dishes being washed are not sanitized. This test is call "indirect" because it does not directly monitor the cleanliness of the wash water in the wash tank 20. Instead it monitors the amount of time the drying agent pump motor 19 has been on since the last time the wash tank 20 was purged and refilled. This is generally a good measure of how many dishes have been washed and thus a measure of how dirty the wash water is. Note that rinse water flow time is equivalent to drying agent pump motor 19 on time because the motor 19 is always on when the flow of rinse water is detected.

The maximum amount of time allowable between replacements of the wash water is set by the installer of the monitor/controller 31 using the pot-dial 37 corresponding signal input 44*a*. The idea here is that an attentive dishwasher operator will periodically check the dirtiness of the wash water and will purge and replace it before the maximum wash water usage time elapses. But if the operator does not do so, then the monitor/controller 31 will turn on a warning light 36 and will transmit an oral message via speaker 39 warning of the problem and explaining what to do.

As explained above, the monitor/controller 31 can detect when the wash water is purged by detecting the open circuit between the conductivity probes 33. Each time the wash water is purged the dirty wash water timer is reset to zero.

The third indirect test also measures the amount of time the drying agent pump motor 19 is used. Its purpose is to periodically remind the dishwasher operator to periodically inspect the dishwasher rinse arms and the insides of the tank for excessive build-up of calcium carbonate scale. This inspection is best done when the wash tank 20 is empty. Also this inspection need not be performed every time the wash tank 20 is purged. Therefore, in the preferred embodiment the drying agent motor 19 time is accumulated until twice the maximum wash water replacement time has passed. Then, the next time the monitor/controller 31 detects that the wash tank 20 is empty it transmits a message over the speaker 39 reminding the operator to perform the required inspection. Upon broadcast of this message the timer is reset to zero.

Generally, the detection of a fault by means of the above described tests requires that the corresponding physical condition be measured several times, and in some cases continually for a period of one second, until the monitor/controller 31 concludes that the fault in fact exists. This process of fault filtering helps prevent the generation of false alarms.

The generation of spoken messages is performed as follows. The speech chip 43 uses standard linear predictive coding technology allowing the user to select the quality of speech generated by selecting the number of bytes of memory allocated to storing the speech. In the preferred embodiment the speech ship processes approximately 1.5k bits per second, producing rough but comprehensible speech. Also, to conserve memory, but at expense of sound quality, only individual words are stored instead of whole phrases. For the words generated in this embodiment, 6k bytes of storage was sufficient. The computer program for the microprocessor 31 occupies approximately 1.5k of the remaining 2k bytes in EPROM 42. The computer program includes a table of the starting addresses of each word stored in the EPROM 42 for use with the speech chip 43.

In order to use a single EPROM 42 for storing both the microprocessor computer program and the speech data it is necessary to carefully subdivide the usage of the bus 45 during a single machine instruction cycle so that two bytes of data from the EPROM—one of speech data and one of program code—are serially transmitted first to one device and then the other.

The speech chip 43 sends a ready signal to the microprocessor port TØ whenever it is ready for more speech data. The microprocessor 31 sends it data which has encoded in the last byte of the data for each spoken word an end-of-word marker. Upon detecting this end-of-word marker the speech chip 43 purges any excess data in its registers and sends to the microprocessor 31 a signal indicating the end of the word has been detected.

When the monitor/controller 31 transmits a message it serially transmits each word in each phrase of the message with a predetermined delay between each word and a longer delay between each phrase. Generally each phrase is transmitted a second time, after a short pause, to ensure the operator has a chance to hear and understand what is being said. Also, if the fault is not corrected within a predetermined amount of time, generally between two minutes and ten minutes, the whole message is repeated. This wait and repeat message sequence continues until the fault is fixed. Therefore, if the operator was out of earshot or was making too much noise at the time to hear the message he would be given a second chance to hear it.

As indicated above, oral start-up and shutdown instructions can be activated by use of switch 38. Switch 38 is a two-position center-position-off switch. When pushed one way (e.g., to the left) start-up instruction messages are generated, and when pushed the other way shutdown instruction messages are generated.

Each time the switch 38 is pushed, or toggled, one phrase or instruction is spoken. After the operator performs the instruction he can push the switch 38 again to get the next instruction. This sequence continues until either all the instructions are spoken or the operator fails to push the button for a predetermined amount of time, such as three and one-half minutes. In that case the monitor/controller 31 assumes the operator requires no further instruction and it returns to the task of looking for other faults.

The start-up and shutdown instruction sequences can be used both for training purposes and for helping substitute personnel filling in for the usual dishwasher operator. Generally, though, this facility will probably not be used once the dishwasher operator has gone through the sequence two or three times.

Referring to Table 1, there is shown each of the messages generated for each fault or error condition and also the start-up and shutdown instruction sequences. For the fault messages the "/" indicates a pause between each phrase. For the start-up and shutdown instruction sequences the "/" indicates the end of each instruction which is activated by a separate toggle of switch 38.

While the present invention has been described with reference to a specific embodiment, the description is illustrative of the invention and is not to be construed as limiting the invention. Various modifications may occur to those skilled in the art without departing from the true spirit and scope of the invention as defined by the appended claims.

TABLE 1

| | Speech Phrases<br>Text |
|---|---|
| Alarm | |
| Low Detergent | Beep Beep/Low detergent/Low detergent/Add more detergent now/Add more detergent now. |
| Low Wash Temperature | Beep Beep/Low wash temperature/Low wash temperature/Make sure heater controls on/Make sure heater controls on. |
| Low Rinse Temperature | Beep Beep/Low rinse temperature/Low rinse temperature/Check reset button/Check reset button. |
| Dirty Wash Tank Water | Beep Beep/Wash tank water/Wash tank water/Drain dirty wash tank water/Drain dirty wash tank water/Clean scrap trays/Clean scrap trays/Refill wash tank/Refill wash tank. |
| Low Drying Agent | Beep Beep/Low drying agent/Low drying agent/Add more drying agent now/Add more drying agent now/Make sure supply hose in place/Make sure supply hose in place. |
| Check Rinse Arms | Beep Beep/Check rinse arms/Check rinse arms/Clean out dirty or clogged rinse jets/Clean out dirty or clogged rinse jets/Clean or descale tank/Clean or descale tank. |
| Instruction | |
| Start-Up | Replace wash arms/Place clean scrap trays in machine/Place clean curtains in machine/Close doors/Close drain valves/Open fill valves/When full, close fill valves/Turn on heater/Wait for temperature guage to reach correct operating temperature/Turn on pumps/Make sure detergent and drying agent feeders are on/Start washing. |
| Shut-Down | Turn pumps off/Turn heaters off/Open drain valves/Open doors/ |

TABLE 1-continued

| Speech Phrases |
| --- |
| Text |
| Remove curtains and scrap trays, clean and air dry/Remove wash arms and clean/Hose out machine. |

What is claimed is:

1. In a dishwasher system having rinse water receiving means, detergent receiving means and detergent dispensing means, and wash tank means for holding a quantity of water, monitor/controller apparatus comprising:

electrode means for both measuring the concentration of detergent in the water in said wash tank means and for detecting when said wash tank is empty;

detergent dispenser control means for activating said detergent dispensing means to add detergent to the water in said wash tank means when said electrode means detects that the concentration of detergent in the water in said wash tank is less than a preselected concentration value;

detergent fault means for detecting when the concentration of detergent in said wash tank does not reach said preselected concentration value after said detergent dispenser means has been activated for a preselected length of time and for transmitting a first speech message when said detergent fault is detected;

rinse water fault means for detecting when the temperature of water in said rinse water receiving means falls below a preselected minimum rinse water temperature value and for transmitting a second speech message when said rinse water temperature fault is detected;

rinse water detection means for detecting when water is flowing through said rinse water receiving means into said dishwasher; and wash water purge fault means responsive to said electrode means and said rinse water detection means for detecting if the cumulative length of time that water has been flowing in said rinse water receiving means since the last time said wash tank means was empty exceeds a preselected dirty water delay period and for transmitting a third speech message when said purge fault is detected.

2. Monitor/controller apparatus as set forth in claim 1 further including:

drying agent receiving means and drying agent dispensing means;

low wash temperature fault means for detecting when the temperature of the water in said wash tank means falls below a preselected minimum wash water temperature value and for transmitting a fourth speech message when said wash water temperature fault is detected;

drying agent control means for activating said drying agent dispensing means to add drying agent to said rinse water receiving means when said rinse water detection means detects water flowing therein; and drying agent fault means for detecting the absence of drying agent in said drying agent receiving means and for transmitting a fifth speech message when said drying agent fault is detected.

3. Monitor/controller apparatus as set forth in claim 1 further including:

inspection fault means for transmitting a sixth speech message when said electrode means detects the wash tank is empty and the cumulative length of time said rinse water has been flowing since the last time said sixth speech message was transmitted exceeds a preselected inspection delay period; and instruction means, including switch means for activating said instruction means, and means for sequentially generating predetermined instruction speech messages in response to sequential signals from said switch means, wherein said instruction speech messages contain words explaining how to operate said dishwasher system.

* * * * *